US010633944B2

(12) United States Patent
Williamson, Jr.

(10) Patent No.: US 10,633,944 B2
(45) Date of Patent: Apr. 28, 2020

(54) SELECTIVE TEST TOOL

(71) Applicant: Halliburton Energy Services, Inc., Houston, TX (US)

(72) Inventor: Jimmie Robert Williamson, Jr., Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 229 days.

(21) Appl. No.: 15/554,709

(22) PCT Filed: Nov. 9, 2016

(86) PCT No.: PCT/US2016/061166

§ 371 (c)(1),
(2) Date: Aug. 30, 2017

(87) PCT Pub. No.: WO2018/089000

PCT Pub. Date: May 17, 2018

(65) Prior Publication Data

US 2019/0234164 A1 Aug. 1, 2019

(51) Int. Cl.

| | |
|---|---|
| ***E21B 23/02*** | (2006.01) |
| ***E21B 23/03*** | (2006.01) |
| ***E21B 47/09*** | (2012.01) |
| ***E21B 33/12*** | (2006.01) |
| *E21B 47/10* | (2012.01) |

(52) U.S. Cl.
CPC ..... *E21B 23/02* (2013.01); *E21B 33/12* (2013.01); *E21B 47/1025* (2013.01)

(58) Field of Classification Search
CPC ..... E21B 23/02; E21B 23/03; E21B 47/09
See application file for complete search history.

(56) References Cited

U.S. PATENT DOCUMENTS

| | | | | |
|---|---|---|---|---|
| 4,046,006 | A | 9/1977 | Dufrene | |
| 4,962,813 | A * | 10/1990 | Welch | E21B 34/105 166/217 |
| 5,119,875 | A * | 6/1992 | Richard | E21B 23/04 166/212 |
| 5,398,764 | A | 3/1995 | Collins | |
| 2002/0121373 | A1 | 9/2002 | Patel | |
| 2004/0238185 | A1 | 12/2004 | Rothers et al. | |
| 2013/0104643 | A1 | 5/2013 | Tokarek | |

FOREIGN PATENT DOCUMENTS

WO 2014099588 A1 6/2014

* cited by examiner

*Primary Examiner* — Catherine Loikith
(74) *Attorney, Agent, or Firm* — Scott Richardson; Parker Justiss, P.C.

(57) ABSTRACT

A selective service tool has a key prop mandrel that is slidably coupled to and extends over a cage mandrel. The lower end of the key prop mandrel has key props that extend from its lower end. A key has first and second opposing sections located about an outer perimeter and adjacent an upper end of the locator mandrel, wherein the key props are slidable with respect to the key and are positionable between the first section and the outer perimeter of the locator mandrel and the second section and the outer perimeter of the locator mandrel, respectively, when the key is in a deployed position.

19 Claims, 4 Drawing Sheets

SELECTIVE TEST TOOL

CROSS-REFERENCE TO RELATED APPLICATION

This application is the National Stage of, and therefore claims the benefit of, International Application No. PCT/US2016/061166 filed on Nov. 9, 2016, entitled "SELECTIVE TEST TOOL,". The above application is commonly assigned with this National Stage application and is incorporated herein by reference in its entirety.

BACKGROUND

After several years of production, an oil or gas well can begin experiencing problems with production tubing. For example, the chemicals present in the production fluids can corrode the tubing to the point that the tubing develops a leak. When this occurs, the operator has the oil or gas well serviced to test the production tubing to determine the point of the failure. Typically, this is done with a selective testing tool that cooperates with landing nipples that are placed along the length of the wellbore. Landing nipples are run into the well on the completion tubing to provide specific landing locations for subsurface flow control equipment. These landing nipples, which may be chosen based on the weight of the tubing, feature common internal profiles making them universal. The completion can include as many landing nipples with the same interior diameter ID in any sequence as desired on the tubing string. This versatility results in an unlimited number of positions for setting and locking subsurface flow controls.

The flow control device, which is attached to the lock mandrel, may be run into the well via a coiled tubing or slickline. The operator can set the flow control device in any one of the landing nipples at the desired depth. If the target location is unsatisfactory or if well conditions change, the flow control device may be moved up or down the tubing string to another nipple location.

BRIEF DESCRIPTION

Figure 1:
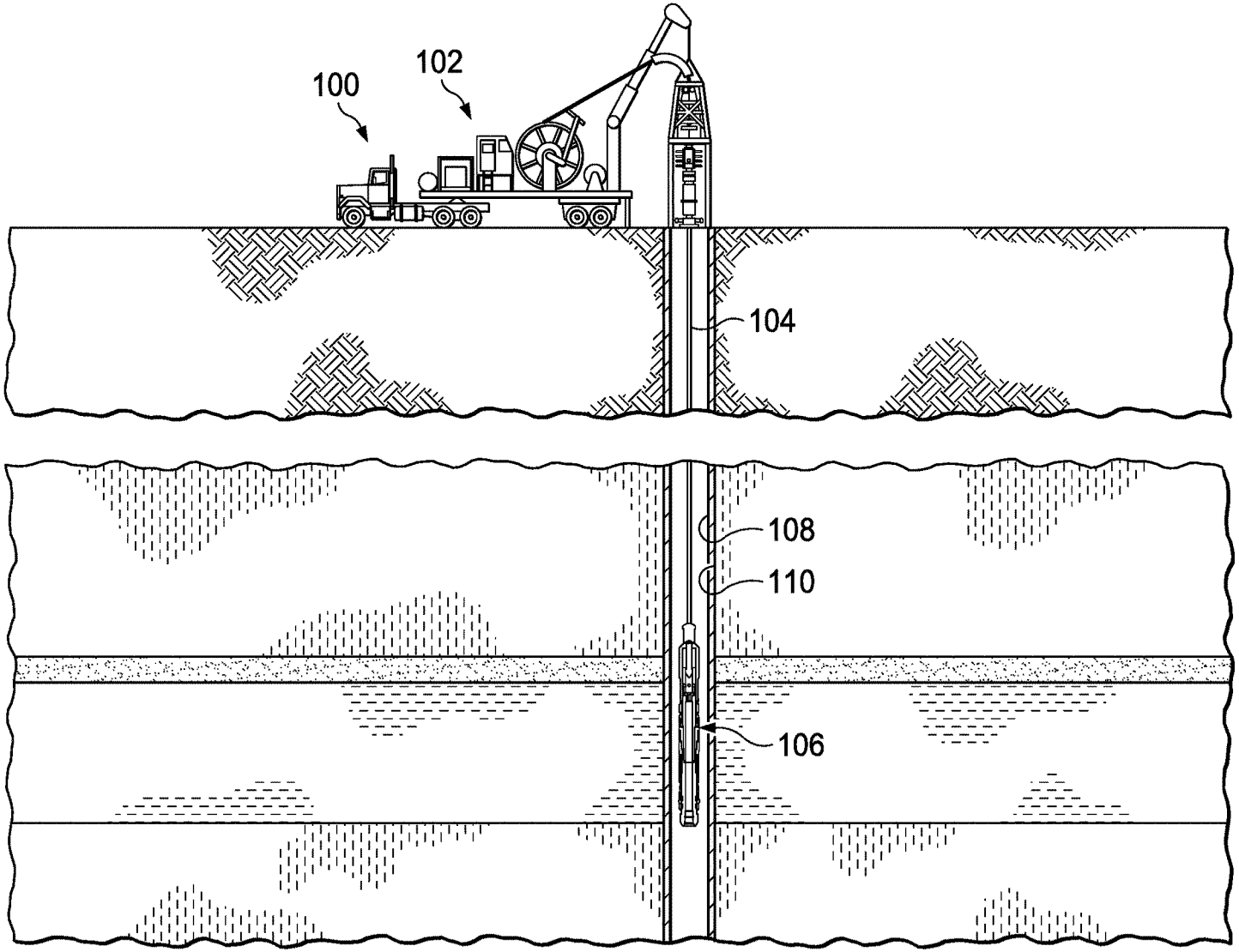
Figure 2A:
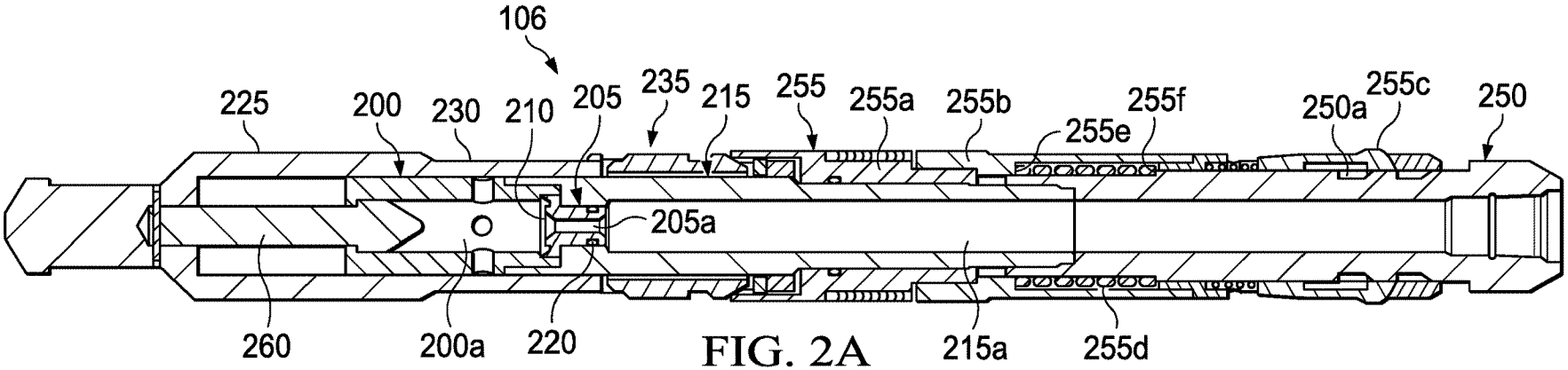
Figure 2B:
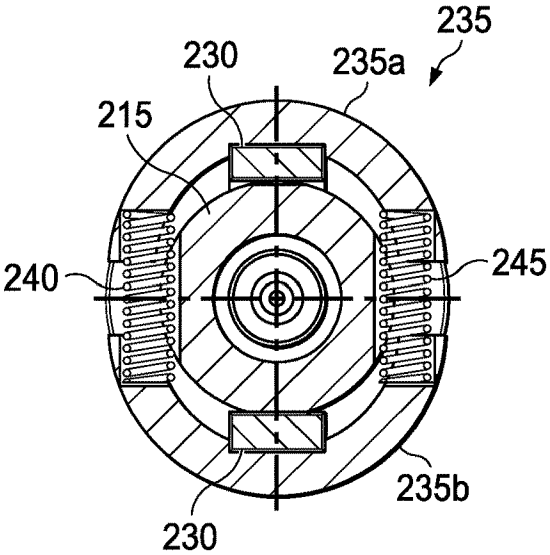
Figure 3A:
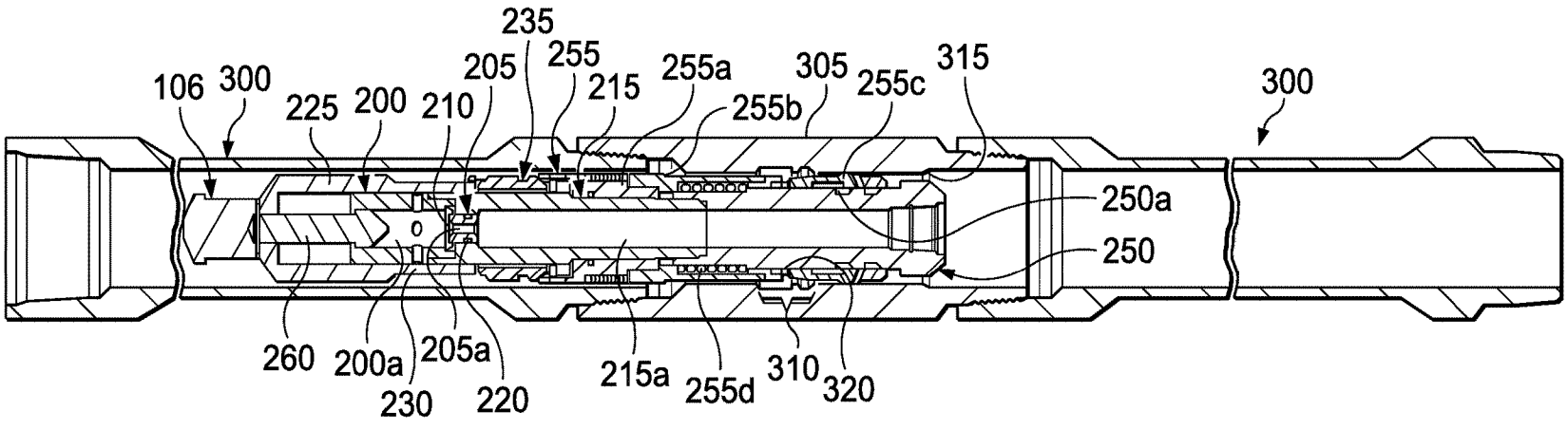
Figure 3B:
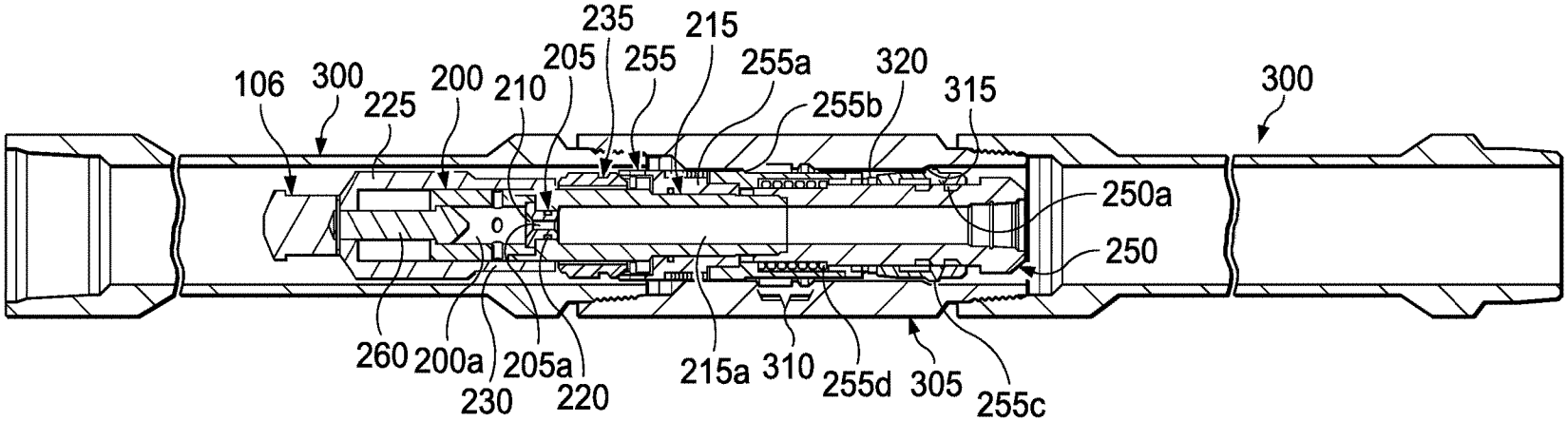
Figure 3C:
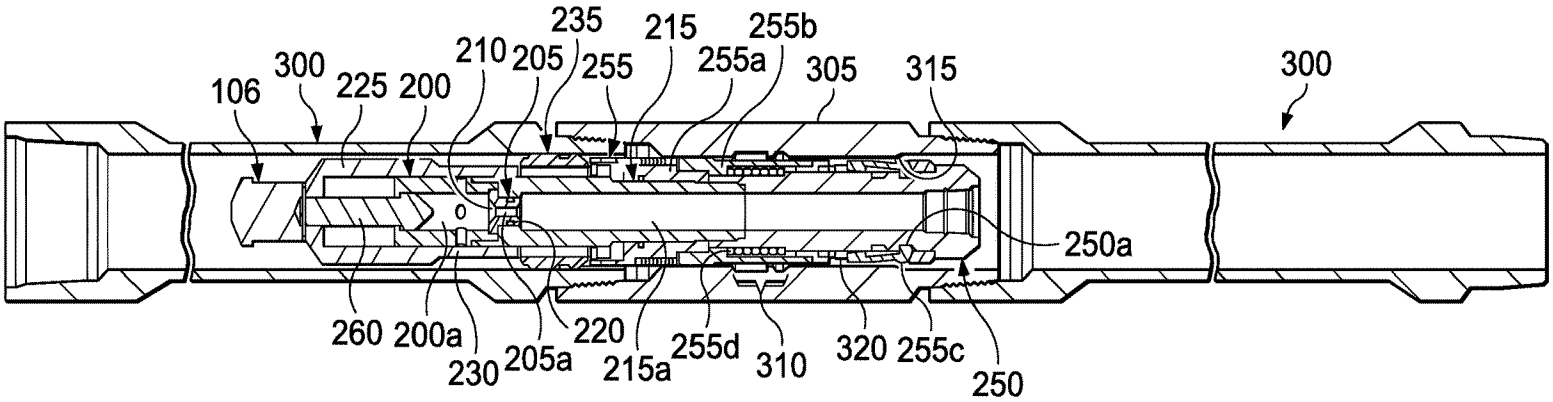
Figure 3D:
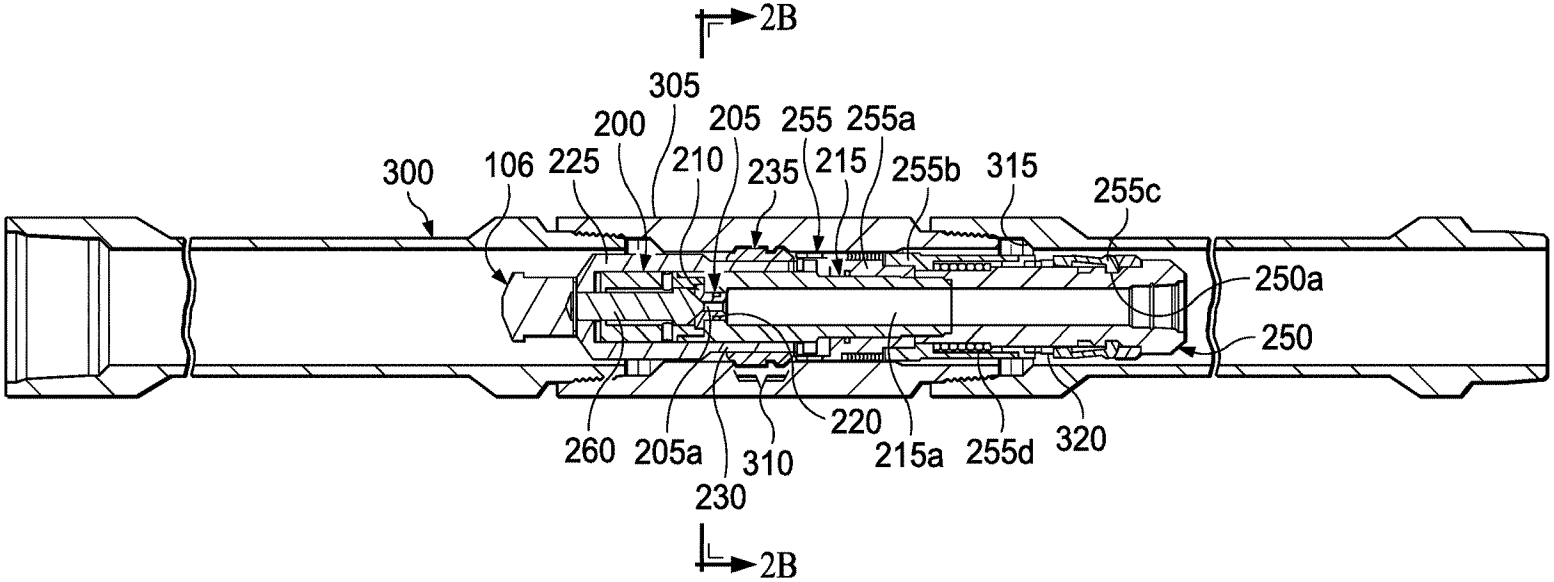

Reference is now made to the following descriptions taken in conjunction with the accompanying drawings, in which:

FIG. 1 schematically illustrates a well servicing system;

FIG. 2A schematically illustrates a sectional view of the selective service tool;

FIG. 2B schematically illustrates a sectional view of the key and key spring;

FIG. 3A schematically illustrates a sectional view of the selective service tool in the well bore;

FIG. 3B schematically illustrates a sectional view of the selective service tool with the dog engaged against a landing nipple profile shoulder;

FIG. 3C schematically illustrates a sectional view of the selective service tool with the key in a deployed position; and FIG. 3D schematically illustrates a sectional view of the selective service tool with the key props positioned between the key and the locator mandrel.

DETAILED DESCRIPTION

This disclosure, in its various embodiments, provides a service tool having an improved key mechanism that locks a profile key into a landing nipple profile of a well tubing to ensure improved testing of the tubing's integrity.

In the drawings and descriptions that follow, like parts are typically marked throughout the specification and drawings with the same reference numerals, respectively. The drawn figures are not necessarily to scale. Certain features of this disclosure may be shown exaggerated in scale or in somewhat schematic form and some details of conventional elements may not be shown in the interest of clarity and conciseness. Specific embodiments are described in detail and are shown in the drawings; with the understanding that they serve as examples and that, they do not limit the disclosure to only the illustrated embodiments. Moreover, it is fully recognized that the different teachings of the embodiments discussed, below, may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements but include indirect connection or interaction between the elements described, as well. As used herein and in the claims, the phrases, "operatively connected" or "configured" mean that the recited elements are connected either directly or indirectly in a manner that allows the stated function to be accomplished. These terms also include the requisite physical structure(s) that is/are necessary to accomplish the stated function.

In the following discussion and in the claims, the terms "including" and "comprising" are used in an open-ended fashion, and thus should be interpreted to mean "including, but not limited to." Unless otherwise specified, any use of any form of the terms "connect," "engage," "couple," "attach," or any other term describing an interaction between elements is not meant to limit the interaction to direct interaction between the elements but include indirect interaction between the elements described, as well. References to up or down are made for purposes of description with "up," "upper," or "uphole," meaning toward the surface of the wellbore and with "down," "lower," "downward," "downhole," or "downstream" meaning toward the terminal end of the well, as the tool would be positioned within the wellbore, regardless of the wellbore's orientation. Further, any references to "first," "second," etc. do not specify a preferred order of method or importance, unless otherwise specifically stated, but such terms are intended to distinguish one element from another. For example, a first element could be termed a second element, and, similarly, a second element could be termed a first element, without departing from the scope of example embodiments. Moreover, a first element and second element may be implemented by a single element able to provide the necessary functionality of separate first and second elements.

The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 generally illustrates a system 100 used to conduct the servicing operations as described herein. In one embodiment, the system 100 comprises a conventional workover rig or truck 102 that supplies a coiled tubing, slickline, or workover string 104 to which a selective service tool 106, embodiments of which are described herein, is attached. The system 100 may also include a computer, including the associated hardware and software, for controlling and monitoring the operations of the selective service tool 106 during the testing operations, as previously described. The operator may use a conventional monitoring system to determine when the selective service tool 106 has reached the appropriate depth in the tubing 108 of the wellbore 110. When the appropriate profile depth is reached, the selective service tool 106 is operated to conduct testing on the tubing. Thus, the present disclosure presents embodiments of a selective service tool 106 and system 100 that provides improved setting of the service tool 106 and sealing between the downhole and uphole portions of the tubing 108. The wellbore 110 may be, for example, an oil and gas well, or it may be a water well or other production well that produces fluids. The tubing 108 may be tested in sections either from the top down or bottom up to determine which section or sections of tubing 108 are damaged or need replacing.

FIG. 2A illustrates a sectional view of an embodiment of the selective service tool 106. This embodiment comprises a cage mandrel 200. As used herein and in the claims, it should be understood, that unless otherwise specified, that the term "mandrel" is a tubular component that has a fluid passageway that extends along its lengths to allow for the passage of oil, gas, or other fluids, through the mandrel. The cage mandrel 200 has a fluid passageway 200*a* that extends through its length. A seat insert 205 is located within the cage mandrel 200 and is coupled to the cage mandrel 200 adjacent its lower end, as shown in the illustrated embodiment. The seat insert 205 may be coupled to the cage mandrel 200 by conventional means, such as by threads, pins, etc. In the illustrated embodiment, the seat insert 205 abuts a shoulder formed in an interior wall of the cage mandrel 200, as shown. The seat insert 205 has a fluid passageway 205*a* that extends through its length and has a first seal ring 210 located adjacent an upper end of the fluid passageway 205*a*. The lower end of the cage mandrel 200 is coupled to an upper end of a locator mandrel 215. The coupling may also be achieved by conventional means, such as cooperating threads. The seat insert 205 is captured between a shoulder formed in an interior wall of the cage mandrel 200 and the interior wall of the locator mandrel 215 and extends into the upper portion of the locator mandrel 215. The locator mandrel also has a fluid passageway 215*a* that extends along its length. The fluid passageway 205*a* of the seat insert 205 fluidly connects the fluid passageways 200*a* and 215*a* of the cage and locator mandrels 200, 215, respectively. In one embodiment, an additional seal 220 seals a space between the outer wall of the seat insert 205 and the interior wall of the locator mandrel 215.

The selective service tool 106 further comprises a key prop mandrel 225 that slidably extends over the cage mandrel 200. The lower end of the key prop mandrel 225 includes key props 230. In an embodiment, the key props 230 may be integrally formed with the key prop mandrel 225, as shown, or they may be a separate component that is coupled to the key prop mandrel 225 by conventional means, such as by threads. In an embodiment, the circumferential perimeter of the key props 230 are not co-extensive with the circumferential perimeter of the key prop mandrel 225, such that they form opposing separated sections, as seen in FIG. 2B.

The key props 230 are configured to be inserted under and support a key 235 in a deployed position, as generally shown in the sectional view 2B-2B of the embodiment illustrated in FIG. 3D, as discussed below. A deployed position is when the key 235 is released from a retracted position and is biased outwardly from the locator mandrel 215. In the illustrated embodiment of FIG. 2B, the key 235 has first and second opposing sections 235*a*, 235*b* that are located about an outer perimeter and adjacent an upper end of the locator mandrel 215. The first and second opposing sections 235*a*, 235*b* of the key 235 have tapered shoulders that allow the first and second opposing sections 235*a*, 235*b* to be forced toward the locator mandrel 215, which release them from the profile, allowing selective service tool 106 to be moved to another landing nipple. The opposing key props 230 are positionable between the first section 235*a* and the outer perimeter of the locator mandrel 215 and the second section 235*b* and the outer perimeter of the locator mandrel 215, respectively, when the key 235 is in a deployed position. The key props prevents first and second key sections 235*a*, 235*b* from unseating from the landing nipple profile inadvertently, thereby ensuring that testing can be completed with greater integrity.

In one embodiment, first and second sections 235*a*, 235*b* are biased by opposing springs 240, 245, and in one aspect, there are six helical springs (two pairs of three opposing springs) on each side that bias the first and second section 235*a*, 235*b* to a deployed position.

In conventional devices, leaf springs are often used to bias profile keys into a deployed position. However, leaf springs often do not provide a sufficient biasing force to allow the key to be firmly seated in the targeted landing nipple profile, particularly if there is debris in the targeted landing nipple profile. In such instances, the key can release from the landing nipple profile and cause the integrity of the test to fail. However, an embodiment using helical springs, as just described above, provides a much stronger biasing configuration that overcomes the problems associated with leaf springs.

In other embodiments, the selective service tool 106 further comprises a main mandrel 250 that is coupled to the locator mandrel 215 by conventional means, such as threads.

Other embodiments further comprise a key retainer 255 that is slidably positionable from a retaining position to a retracted position with respect to the key 235 that allows the key 235 to move to the deployed position. The key retainer 255 extends over a portion of the key 235, which retains the key 235 in a retracted or non-deployed position, as generally seen in the illustrated embodiment. When the selective service tool 106 is manipulated in the manner described below, the key retainer 255 slides downwardly off the key 235, which allows it to bias to the deployed position. In one embodiment, the key retainer 255 comprises a retainer section 255*a* coupled to a spring housing 255*b*. The spring housing 255*b* is coupled to a dog 255*c* that is slides along the main mandrel 250 and engages a recess profile 250*a* of the main mandrel 250, that is, it is slidably engageable with the recess profile 250*a*. The retainer section 255*a* is slidable with respect to the locator mandrel 215, and the spring housing is slidable with respect to the locator mandrel 215 and the main mandrel 250. A first spring 255*d* is captured between a shoulder 255*e* of the spring housing 255*b* and a shoulder 255*f* of the main mandrel 250 that extends along a length of the main mandrel 250, as generally shown.

In another embodiment, the key prop mandrel 225 comprises a drop seal 260 that has a first end coupled to an upper end of the key prop mandrel 225 and a second end that is slidably captured within the cage mandrel 200. The second end is configured to be received within the upper end of the seat retainer 205 to form a seal between the cage mandrel fluid passageway 200*a* and the locator mandrel fluid passageway 215*a*. In the illustrated embodiment, the drop seal 260 has a tapered or cone-shaped end that allows it to seat securely against the seat retainer 205. The drop seal 260 couples the key prop mandrel 225 to the cage mandrel 200.

Having set forth embodiments of the selective service tool 106, a method of the operation of its various embodiments will be discussed with reference to FIGS. 3A-3D. FIG. 3A shows an embodiment of the selective service tool 106 positioned in a conventional well tubing 300, such as production tubing. The well tubing 300 has one or more landing nipples 305 positioned along its length. The landing nipple 305 has a landing nipple profile 310 into which the key 235 may be received during the service operation. The landing nipple 305 may also include one or more engagement shoulders 315 against which the dog 255*c* may engage. In FIG. 3A, the selective service tool 106 is being run into/downhole the well tubing 300. The dog 255*c* is biased by a dog spring 320, which allows it to bypass any shoulders or profiles in the well tubing 300 as the selective service tool 106 is being run into the well tubing 300. After the correct depth is reached, the selective service tool 106 is pulled uphole through the tubing 300. The dog spring 320 biases the dog 255*c* outwardly, which allows the dog 255*c* to engage the shoulder 315.

FIG. 3B shows the selective service tool 106 of FIG. 3A with the dog 255*c* engaged against the shoulder 315 of the landing nipple 305. Once the dog 255*c* is engaged against the shoulder 315, an upward force continues to be applied to the selective service tool 106. This pulling action slides the recess 250*a* upward until it reaches the dog 255*c* at which time, the dog 255*c* enters or engages the recess 250*a*. The upward pulling force also compresses the spring 255*d*. These actions provide room for the spring housing 255*b* and the retainer section 255*a* to move downward, which allows the key retainer 255 to move downward and release the key 235, at which time the first and second sections 235*a* and 235*b* of the key 235 are biased to the deployed position, as shown in FIG. 3C.

Referring now to FIG. 3D, after the key 235 is deployed, the selective service tool 106 is then moved downhole until the first and second sections 235*a*, 235*b* of the key 235 seat in the landing nipple profile 310. Downward force continues to be exerted on the selective service tool to force the key props 230 under the keys, as discussed above. This prevents the keys 235 from inadvertently unseating from the landing nipple profile 310. As the key props 230 are positioned under the keys 235, the drop seal 260 moves downwardly within the cage mandrel 200 and contacts the seal ring 210 and forms a seal such that fluid cannot pass from the cage mandrel 200, through the fluid passageway 205*a* and into the fluid passageway 215*a* of the locator mandrel 215 and the main mandrel 250. The seal 220 further prevents fluid from passing from the cage mandrel 200 to the locator mandrel 215. The well tubing 300 is then pressurized uphole from the seal to determine if there are any leaks. Once testing is completed, the selective service tool may be moved up to another landing nipple. In an embodiment, once the key retainer 255 is retracted in the manner described above, it remains in the retracted state during the duration of the testing and may be re-set on the surface subsequent to testing operations. This allows the key 235 to engage and be removed from additional landing nipple profiles.

Embodiments herein comprise:

A selective tool apparatus. This embodiment comprises a cage mandrel having a fluid passageway therethrough and a seat insert located therein and coupled adjacent a lower end thereof. The seat insert has a fluid passage extending therethrough and has a first seal ring located adjacent an upper end of the fluid passage. A locator mandrel having a fluid passageway therethrough is coupled to the cage mandrel adjacent the lower end. A key prop mandrel is slidably coupled to and extends over the cage mandrel. The lower end of the key prop mandrel including key props. The key has first and second opposing sections located about an outer perimeter and adjacent an upper end of the locator mandrel, wherein the key props are positionable between the first section and the outer perimeter and the second section and the outer perimeter of the locator mandrel, respectively, when the key is in a deployed position.

Another embodiment is directed to a well servicing system. This embodiment comprises a servicing rig having a tubing associated therewith. The tubing is positionable within a production tubing of a well that has at least one landing nipple located along its length. The system also includes a servicing tool for testing a production tubing of the well. The servicing tool comprises a cage mandrel having a fluid passageway therethrough and a seat insert located therein and coupled adjacent a lower end thereof. The seat insert has a fluid passage extending therethrough and has a first seal ring located adjacent an upper end of the fluid passage. A locator mandrel is coupled to the cage mandrel adjacent the lower end and has a fluid passageway therethrough. A key prop mandrel is slidably coupled to and extends over the cage mandrel. The lower end of the key prop mandrel includes key props. This embodiment further comprises a key having first and second opposing sections located about an outer perimeter and adjacent an upper end of the locator mandrel. It has an outer diameter profile that is cooperatively engagable with a landing nipple profile of a production tubing of a well, wherein the key props are positionable between the first section and the outer perimeter of the locator mandrel and the second section and the outer perimeter of the locator mandrel, respectively, when the key is in a deployed position. A drop seal has a first end that is coupled to an upper end of the key prop mandrel and a second end that is slidably captured within the cage mandrel. The second end is configured to be received within the upper end of the seat insert 205 to form a seal between the fluid passageway of the cage mandrel and the fluid passageway of the locator mandrel. This embodiment also comprises a key retainer that is slidably positionable from a retaining position to a retracted position with respect to the key to allow the key to move to the deployed position.

Another embodiment is directed to a method of testing a production tubing in a well. This embodiment comprises attaching a service tool to a service tubing, wherein the service tool comprises a cage mandrel having a fluid passageway therethrough and a seat insert located therein and coupled adjacent a lower end thereof. The seat insert has a fluid passage extending therethrough and has a first seal ring located adjacent an upper end of the fluid passage. A locator mandrel is coupled to the cage mandrel adjacent the lower end and has a fluid passageway therethrough. A key is present that has first and second opposing sections located about an outer perimeter and adjacent an upper end of the locator mandrel. A key prop mandrel is slidably coupled to and extends over the cage mandrel. The key prop mandrel has key props that are positionable between the first section of the key and the outer perimeter of the locator mandrel and the second section of the key and the outer perimeter of the locator mandrel, respectively, when the key is in a deployed position. This embodiment further comprises using the service tubing to position the service tool at a first location within the well, moving the key to a deployed position, moving the service tool uphole until the key engages a first landing nipple profile of a production tubing, positioning the key props between the first section and the outer perimeter of the locator mandrel and the second section and the outer perimeter of the locator mandrel, respectively, when the key is engaged with the landing nipple profile, moving the drop seal into the seat insert to engage the first seal ring to create a seal between the fluid passageway of the cage mandrel and the fluid passageway of the locator mandrel, and pressuring the production tubing of the well uphole of the seal.

Each of the foregoing embodiments may comprise one or more of the following additional elements singly or in combination, and neither the example embodiments or the following listed elements limit the disclosure, but are provided as examples of the various embodiments covered by the disclosure:

Element 1: further comprising a drop seal having a first end coupled to an upper end of the key prop mandrel and a second end that is slidably captured within the cage mandrel. The second end configured to be received within the upper end of the seat retainer to form a seal between the cage mandrel fluid passageway and the locator mandrel fluid passageway.

Element 2: further comprising a key retainer that is slidably positionable from a retaining position to a retracted position with respect to the key to allow the key to move to the deployed position.

Element 3: wherein the key retainer comprises a retainer section coupled to a spring housing. The spring housing is coupled to a dog that is slidably engageable with a recess profile of a main mandrel that is coupled to the locator mandrel. The retainer section being slidable with respect to the locator mandrel and the spring housing being slidable with respect to the locator mandrel and the main mandrel.

Element 4: further comprising a first spring captured between a shoulder of the spring housing and a shoulder of the main mandrel that extends along a length of the main mandrel.

Element 5: wherein the key has springs on opposing sides thereof that bias the first and second sections outwardly from the outer perimeter to the deployed posit.

Element 6: wherein the springs are opposing pairs of helical springs.

Element 7: wherein the seat insert has a second seal positioned about an outer diameter of the seat insert that forms a seal between the seat insert and the locator mandrel.

Element 8: wherein the key retainer comprises a retainer section coupled to a spring housing. The spring housing is coupled to a dog that is slidably engageable with a recess profile of a main mandrel that is coupled to the locator mandrel. The retainer section being slidable with respect to the locator mandrel and the spring housing being slidable with respect to the locator mandrel and the main mandrel.

Element 9: further comprising a first spring captured between a shoulder of the spring housing and a shoulder of the main mandrel that extends along a length of the main mandrel.

Element 10: wherein the key has springs on opposing sides thereof that bias the first and second sections outwardly from the outer perimeter to the deployed position.

Element 11: wherein the springs are opposing pairs of helical springs.

Element 12: wherein the seat insert has a second seal positioned about an outer diameter of the seat insert that forms a seal between the seat insert and the locator mandrel.

Element 13: wherein moving the key to the deployed position includes sliding a key retainer of the service tool downwardly with respect to the locator mandrel to a releasing position to thereby release the key to allow the key to move to the deployed position.

Element 14: wherein the moving of the key props and the drop seal occur simultaneously.

Element 15: wherein moving the key to the deployed position, includes engaging a dog that is coupled to the key retainer against a shoulder of the landing nipple and pulling the service tool uphole until the dog is received within a recess of a main mandrel that is coupled to the locator mandrel.

Element 16: wherein the pulling causes a spring captured in a spring housing coupled to a retainer section of the key retainer to compress to allow the retainer section to slide downhole from the key and thereby allow the key to move to the deployed position.

Element 17: further comprising moving the service tool either uphole or downhole to a second landing nipple profile and engaging the key in the second landing nipple and testing the production tubing located uphole of the seal.

The foregoing listed embodiments and elements do not limit the disclosure to just those listed above, and those skilled in the art to which this application relates will appreciate that other and further additions, deletions, substitutions and modifications may be made to the described embodiments.

What is claimed is:

1. A selective tool apparatus, comprising:

a cage mandrel having a fluid passageway therethrough and a seat insert located therein and coupled adjacent a lower end thereof, said seat insert having a fluid passage extending therethrough and having a first seal ring located adjacent an upper end of said fluid passage;

a locator mandrel having a fluid passageway therethrough and coupled to said cage mandrel adjacent said lower end of said cage mandrel;

a key prop mandrel slidably coupled to and extending over said cage mandrel, a lower end of said key prop mandrel including key props;

a key having first and second opposing sections located about an outer perimeter and adjacent an upper end of said locator mandrel, wherein said key props are slidable with respect to said key and positionable between a first section and said outer perimeter of said locator mandrel and a second section and said outer perimeter of said locator mandrel, respectively, when said key is in a deployed position; and a drop seal having a first end coupled to an upper end of said key prop mandrel and a second end that is slidably captured within said cage mandrel, said second end configured to be received within an upper end of said seat insert to form a seal between said fluid passageway of said cage mandrel and said fluid passageway of said locator mandrel.

2. The apparatus of claim 1, further comprising a key retainer that is slidably positionable from a retaining position to a retracted position with respect to said key to allow said key to move to said deployed position.

3. The apparatus of claim 2, wherein said key retainer comprises a retainer section coupled to a spring housing, said spring housing coupled to a dog that is slidably engageable with a recess profile of a main mandrel that is coupled to said locator mandrel, said retainer section being slidable with respect to said locator mandrel and said spring housing being slidable with respect to said locator mandrel and said main mandrel.

4. The apparatus of claim 3, further comprising a first spring captured between a shoulder of said spring housing and a shoulder of said main mandrel that extends along a length of said main mandrel.

5. The apparatus of claim 1, wherein said key has springs on opposing sides thereof that bias said first and second sections outwardly from said outer perimeter to said deployed position.

6. The apparatus of claim 5, wherein said springs are an opposing pair of helical springs.

7. The apparatus of claim 1, wherein said seat insert has a second seal positioned about an outer diameter of said seat insert that forms a seal between said seat insert and said locator mandrel.

8. A well servicing system, comprising:

a servicing rig having a tubing associated therewith, said tubing positionable within a production tubing of a well that has at least one landing nipple located along its length;

a servicing tool for testing said production tubing of said well, said servicing tool comprising:

a cage mandrel having a fluid passageway therethrough and a seat insert located therein and coupled adjacent a lower end thereof, said seat insert having a fluid passage extending therethrough and having a first seal ring located adjacent an upper end of said fluid passage of said cage mandrel;

a locator mandrel coupled to said cage mandrel adjacent said lower end and having a fluid passageway therethrough;

a key prop mandrel slidably coupled to and extending over said cage mandrel, a lower end of said key prop mandrel including key props;

a key having first and second opposing sections located about an outer perimeter and adjacent an upper end of said locator mandrel, and having an outer diameter profile that is cooperatively engageable with a landing nipple profile of said production tubing of said well, wherein said key props are slidable with respect to said key and positionable between said first section and said outer perimeter of said locator mandrel and between said second section and said outer perimeter of said locator mandrel, respectively, when said key is in a deployed position;

a drop seal having a first end coupled to an upper end of said key prop mandrel, and a second end that is slidably captured within said cage mandrel and being configured to be received within an upper end of said seat insert to form a seal between said fluid passageway of said cage mandrel and said fluid passageway of said locator mandrel; and a key retainer that is slidably positionable from a retaining position to a retracted position with respect to said key to allow said key to move to said deployed position.

9. The system of claim 8, wherein said key retainer comprises a retainer section coupled to a spring housing, said spring housing coupled to a dog that is slidably engageable with a recess profile of a main mandrel that is coupled to said locator mandrel, said retainer section being slidable with respect to said locator mandrel and said spring housing being slidable with respect to said locator mandrel and said main mandrel.

10. The system of claim 9, further comprising a first spring captured between a shoulder of said spring housing and a shoulder of said main mandrel that extends along a length of said main mandrel.

11. The system of claim 8, wherein said key has springs on opposing sides thereof that bias said first and second sections outwardly from said outer perimeter to said deployed position.

12. The system of claim 11, wherein said springs are an opposing pair of helical springs.

13. The system of claim 8, wherein said seat insert has a second seal positioned about an outer diameter of said seat insert that forms a seal between said seat insert and said locator mandrel.

14. A method of testing a production tubing in a well, comprising:

attaching a service tool to a service tubing, said service tool comprising:

a cage mandrel having a fluid passageway therethrough and a seat insert located therein and coupled adjacent a lower end thereof, said seat insert having a fluid passage extending therethrough and having a first seal ring located adjacent an upper end of said fluid passage;

a locator mandrel coupled to said cage mandrel adjacent said lower end and having a fluid passageway therethrough;

a key having first and second opposing sections located about an outer perimeter and adjacent an upper end of said locator mandrel; and a key prop mandrel slidably coupled to and extending over said cage mandrel, said key prop mandrel having key props that are slidable with respect to said key and positionable between said first section of said key and said outer perimeter of said locator mandrel and said second section of said key and said outer perimeter of said locator mandrel, respectively, when said key is in a deployed position;

using said service tubing to position said service tool at a first location within said well;

moving said key to said deployed position;

moving said service tool, uphole, until said key engages a first landing nipple profile of a production tubing;

positioning said key props between said first section and said outer perimeter and said second section and said outer perimeter of said locator mandrel, respectively, when said key is engaged with said landing nipple profile;

moving a drop seal into said seat insert to engage said first seal ring to create a seal between said fluid passageway of said cage mandrel and said fluid passageway of said locator mandrel; and pressuring said production tubing of said well, uphole of said seal.

15. The method of claim 14, wherein moving said key to said deployed position includes sliding a key retainer of said service tool downwardly with respect to said locator mandrel to a releasing position to thereby release said key and allow said key to move to said deployed position.

16. The method of claim 14, wherein said positioning said key props and moving said drop seal occur simultaneously.

17. The method of claim 14, wherein moving said key to said deployed position, includes engaging a dog that is coupled to said key retainer against a shoulder of said landing nipple and pulling said service tool, uphole, until said dog is received within a recess of a main mandrel that is coupled to said locator mandrel.

18. The method of claim 17, wherein said pulling causes a spring captured in a spring housing coupled to a retainer section of said key retainer to compress to allow said retainer section to slide downhole from said key and thereby allow said key to move to said deployed position.

19. The method of claim 14, further comprising moving said service tool either uphole or downhole to a second landing nipple profile and engaging said key in said second landing nipple and testing said production tubing located uphole of said seal.

* * * * *